US009512977B2

(12) United States Patent
Pickard et al.

(10) Patent No.: US 9,512,977 B2
(45) Date of Patent: Dec. 6, 2016

(54) REDUCED CONTRAST LED LIGHTING SYSTEM

(71) Applicant: Cree, Inc., Durham, NC (US)

(72) Inventors: Paul Kenneth Pickard, Morrisville, NC (US); James Michael Lay, Cary, NC (US)

(73) Assignee: Cree, Inc., Durham, NC (US)

( * ) Notice: Subject to any disclaimer, the term of this patent is extended or adjusted under 35 U.S.C. 154(b) by 0 days.

(21) Appl. No.: 13/749,796

(22) Filed: Jan. 25, 2013

(65) Prior Publication Data

US 2013/0194820 A1 Aug. 1, 2013

Related U.S. Application Data

(60) Provisional application No. 61/590,878, filed on Jan. 26, 2012.

(51) Int. Cl.
*F21V 7/00* (2006.01)
*F21V 13/04* (2006.01)
(Continued)

(52) U.S. Cl.
CPC ..... *F21V 7/0066* (2013.01); *F21S 8/026* (2013.01); *F21V 7/0008* (2013.01); *F21V 13/04* (2013.01);
(Continued)

(58) Field of Classification Search
CPC ... F21S 4/00; F21S 4/001; F21S 4/003–4/008; F21V 13/04; F21V 13/08; F21V 13/10; F21V 2008/001; F21V 2008/002; F21V 5/001; F21V 5/007; F21V 5/008; F21V 5/08; F21V 7/00; F21V 7/0008; F21V 7/0025; F21V 7/0041; F21V 9/08; F21Y 2111/002
(Continued)

(56) References Cited

U.S. PATENT DOCUMENTS 3,270,194 A * 8/1966 Lee ..... 362/218
4,023,034 A * 5/1977 Schacht ..... 250/227.11
(Continued)

FOREIGN PATENT DOCUMENTS

JP H08162677 A 6/1996
WO 2010099755 A1 9/2010
WO 2011140353 A2 11/2011

OTHER PUBLICATIONS

U.S. Appl. No. 12/873,303, filed Aug. 31, 2010.
U.S. Appl. No. 29/467,949, filed Sep. 25, 2013.
U.S. Appl. No. 13/943,152, filed Jul. 16, 2013.

*Primary Examiner* — Jong-Suk (James) Lee
*Assistant Examiner* — Zheng Song
(74) *Attorney, Agent, or Firm* — Steven B. Phillips; Moore & Van Allen PLLC

(57) ABSTRACT

A reduced contrast LED lighting system is disclosed. A plurality optical elements in a fixture is arranged to produce a light pattern with reduced visible contrast between the various areas where light can be perceived leaving the fixture. In some embodiments of the invention the LED light source is disposed at the reflector, and in some such embodiments a partially reflective lens plate is disposed opposite the LED light source. In some embodiments the LED light source is placed opposite the reflector. The lighting system can include a lens arrangement with a partially reflective lens plate connected to a heatsink, or two lens plates adjacent to the LED light source and the heatsink. The fixture can include a plurality of light pipes or slots to direct light into spaces between the lens plates and the heatsink.

4 Claims, 10 Drawing Sheets

(51) Int. Cl.

| | |
|---|---|
| ***F21S 8/02*** | (2006.01) |
| *F21Y 101/02* | (2006.01) |
| *F21Y 113/00* | (2016.01) |
| *F21V 29/70* | (2015.01) |

(52) U.S. Cl.
CPC ..... *F21V 7/005* (2013.01); *F21V 7/0041* (2013.01); *F21V 29/70* (2015.01); *F21Y 2101/02* (2013.01); *F21Y 2113/005* (2013.01)

(58) Field of Classification Search
USPC ..... 362/231, 551, 555, 559, 560, 580,362/217.01–217.07, 241–248, 297–304, 346
See application file for complete search history.

(56) References Cited

U.S. PATENT DOCUMENTS

| | | | | |
|---|---|---|---|---|
| 4,794,501 | A * | 12/1988 | Bartenbach | 362/298 |
| 5,357,413 | A * | 10/1994 | Mandall | 362/300 |
| 5,685,633 | A * | 11/1997 | Engel | 362/223 |
| 5,688,042 | A | 11/1997 | Madadi et al. | |
| 5,988,829 | A * | 11/1999 | Holder | 362/223 |
| 5,988,836 | A * | 11/1999 | Swarens | 362/364 |
| 6,837,593 | B1 * | 1/2005 | Schutz et al. | 362/218 |
| 6,853,151 | B2 | 2/2005 | Leong et al. | |
| 6,860,628 | B2 | 3/2005 | Robertson et al. | |
| 6,936,968 | B2 | 8/2005 | Cross et al. | |
| 7,048,410 | B2 | 5/2006 | Kutler | |
| 7,049,761 | B2 | 5/2006 | Timmermans et al. | |
| 7,114,830 | B2 | 10/2006 | Robertson et al. | |
| 7,178,943 | B2 * | 2/2007 | Holten | 362/245 |
| 7,213,940 | B1 | 5/2007 | Van De Ven et al. | |
| 7,222,992 | B2 * | 5/2007 | Holten et al. | 362/298 |
| 7,307,391 | B2 | 12/2007 | Shan | |
| 7,510,299 | B2 | 3/2009 | Timmermans et al. | |
| 7,520,636 | B2 * | 4/2009 | Van Der Poel | 362/290 |
| 7,588,345 | B1 * | 9/2009 | Davis et al. | 362/223 |
| 7,654,702 | B1 * | 2/2010 | Ding et al. | 362/294 |
| 7,674,005 | B2 * | 3/2010 | Chung et al. | 362/223 |
| 7,768,192 | B2 | 8/2010 | Van De Ven et al. | |
| 7,815,338 | B2 | 10/2010 | Siemiet et al. | |
| 7,926,975 | B2 | 4/2011 | Siemiet et al. | |
| 7,976,196 | B2 | 7/2011 | Ivey et al. | |
| 8,058,659 | B2 | 11/2011 | Bisberg | |
| 8,093,823 | B1 | 1/2012 | Ivey et al. | |
| 8,115,411 | B2 | 2/2012 | Shan | |
| 8,118,447 | B2 | 2/2012 | Simon et al. | |
| 8,247,985 | B2 | 8/2012 | Timmermans et al. | |
| 8,282,247 | B2 | 10/2012 | Ivey et al. | |
| 8,324,817 | B2 | 12/2012 | Ivey et al. | |
| 8,360,599 | B2 | 1/2013 | Ivey et al. | |
| 8,362,710 | B2 | 1/2013 | Langovsky | |
| 8,382,327 | B2 | 2/2013 | Timmermans et al. | |
| 8,419,223 | B2 | 4/2013 | Withers | |
| 8,421,366 | B2 | 4/2013 | Palazzolo et al. | |
| 8,449,137 | B2 | 5/2013 | Dassanayake et al. | |
| 8,482,212 | B1 | 7/2013 | Ivey et al. | |
| 8,573,813 | B2 | 11/2013 | Ivey et al. | |
| 8,596,813 | B2 | 12/2013 | Ivey | |
| 2002/0060526 | A1 | 5/2002 | Timmermans et al. | |
| 2004/0001344 | A1 * | 1/2004 | Hecht | 362/555 |
| 2005/0024878 | A1 * | 2/2005 | Holten | F21S 2/00 362/296.07 |
| 2005/0281024 | A1 * | 12/2005 | Mayfield et al. | 362/221 |
| 2007/0267983 | A1 * | 11/2007 | Van De Ven et al. | 315/294 |
| 2008/0285267 | A1 * | 11/2008 | Santoro | F21V 5/02 362/224 |
| 2009/0279297 | A1 * | 11/2009 | Plunk | 362/235 |
| 2010/0271843 | A1 * | 10/2010 | Holten et al. | 362/609 |
| 2010/0327768 | A1 * | 12/2010 | Kong et al. | 315/294 |
| 2011/0058353 | A1 * | 3/2011 | Yang | 362/84 |
| 2011/0199005 | A1 * | 8/2011 | Bretschneider et al. | 315/152 |
| 2011/0199769 | A1 | 8/2011 | Bretschneider et al. | |
| 2011/0222307 | A1 * | 9/2011 | Kong | 362/554 |
| 2011/0228550 | A1 * | 9/2011 | Robinson | 362/555 |
| 2011/0286214 | A1 * | 11/2011 | Quinlan et al. | 362/235 |

* cited by examiner

REDUCED CONTRAST LED LIGHTING SYSTEM

CROSS-REFERENCE TO RELATED APPLICATION

This application claims priority from commonly-owned, U.S. provisional application Ser. No. 61/590,878, filed Jan. 26, 2012, the entire disclosure of which is hereby incorporated herein by reference.

BACKGROUND

Light emitting diode (LED) lighting systems are becoming more prevalent as replacements for existing lighting systems. LEDs are an example of solid state lighting and have advantages over traditional lighting solutions such as incandescent and fluorescent lighting because they use less energy, are more durable, operate longer, can be combined in multi-color arrays that can be controlled to deliver virtually any color light, and contain no lead or mercury.

In many applications, one or more LED dies (or chips) are mounted within an LED package or on an LED module, which may make up part of a lighting system, a light fixture, lighting unit, lamp, "light bulb" or more simply a "bulb," which includes one or more power supplies to power the LEDs. An LED bulb may be made with a form factor that allows it to replace a standard threaded incandescent bulb, or any of various types of fluorescent lamps. Alternatively, and LED lamp or fixture may be made in the form of a fixture to be used in place of or instead of a standard incandescent or fluorescent fixture.

LED fixtures and lamps often include optical elements external to the LED modules themselves. Such optical elements may allow for diffusion, localized mixing of colors, collimation of light, and/or beam shaping. Optical elements may include reflectors and/or, lenses. Lenses may be of glass or plastic and as examples may take the form of lens plates, total internal reflection (TIR) elements, or more traditional circular, concave or convex lenses.

SUMMARY

Example fixtures embodying the lighting system disclosed herein includes LED devices as the light source positioned on a mounting surface at or near a heatsink, wherein the mounting surface can be positioned either at or near the top of the fixture proximate to a back reflector, or proximate to a lens arrangement of the fixture. The arrangement of the plurality optical elements in a fixture is designed to produce a light pattern with reduced visible contrast between the various areas where light can be perceived leaving the fixture to illuminate a room or portion of a room.

A light fixture according to at least some embodiments of the invention includes a reflector and a centrally disposed LED light source. A lens arrangement for the fixture is configured to reduce contrast across at least a portion of the light fixture. In some embodiments the LED light source is disposed at the reflector, and in some such embodiments a partially reflective lens plate is disposed opposite the LED light source. In some embodiments the LED light source is placed opposite the reflector.

In some embodiments of a light fixture where the light source is placed opposite the reflector, the light fixture includes a lens arrangement with a partially reflective lens plate connected to the heatsink. In some embodiments, the fixture includes a lens arrangement with at least two lens plates adjacent to the LED light source and the heatsink. In the latter case, the fixture can include a plurality of light pipes disposed to direct light into spaces between the lens plates and the heatsink. In some embodiments a plurality of slots in a portion of the lens plates can direct light into spaces between the lens plates and the heatsink.

In some embodiments of the invention, the LED light source in the LED lighting system includes a plurality of LEDs. The LEDs may be encapsulated with modules mounted on a mounting surface of the heatsink. The plurality of optical elements in the fixture or system is arranged relative to the plurality of LEDs and the heatsink to reduce visible contrast in light emanating from the LED lighting system. This plurality of optical elements can include both the reflector and the lens, lenses, or a lens arrangement. In operation, the centrally disposed LED light source in a fixture is energized so that a portion of the light from the LED light source strikes the reflector before leaving the fixture. At least a portion of the light is passed through the lens so that light emanating from the fixture exhibits reduced visual contrast across the fixture.

In some embodiments of the invention, the LED light source includes LEDs having at least two groups of LEDs, wherein one group, if illuminated, would emit light having dominant wavelength from 435 to 490 nm, and another group, if illuminated, would emit light having a dominant wavelength from 600 to 640 nm. In some embodiments LEDs in one group are packaged with a phosphor, which, when excited, emits light having a dominant wavelength from 540 to 585 nm.

DETAILED DESCRIPTION

Figure 1A:
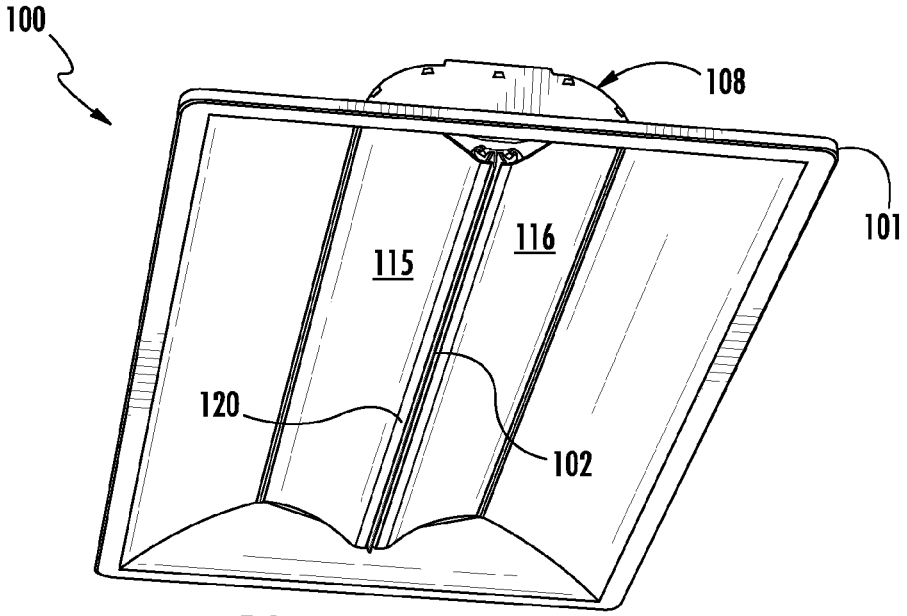
FIG. 1 presents various views of an example embodiment of the invention organized as FIGS. 1A, 1B, 1C, and 1D.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element such as a layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

Unless otherwise expressly stated, comparative, quantitative terms such as "less" and "greater", are intended to encompass the concept of equality. As an example, "less" can mean not only "less" in the strictest mathematical sense, but also, "less than or equal to."

The terms "LED" and "LED device" as used herein may refer to any solid state light emitter. The term "solid state emitter" or similar terms may include a light emitting diode, laser diode, organic light emitting diode, and/or other semiconductor device which includes one or more semiconductor layers, which may include silicon, silicon carbide, gallium nitride and/or other semiconductor materials, a substrate which may include sapphire, silicon, silicon carbide and/or other microelectronic substrates, and one or more contact layers which may include metal and/or other conductive materials. A solid state lighting device produces light (ultraviolet, visible, or infrared) by exciting electrons across the band gap between a conduction band and a valence band of a semiconductor active (light-emitting) layer, with the electron transition generating light at a wavelength that depends on the band gap. Thus, the color (wavelength) of the light emitted by a solid state emitter depends on the materials of the active layers thereof. In various embodiments, solid state light emitters may have peak wavelengths in the visible range and/or be used in combination with lumiphoric materials having peak wavelengths in the visible range. Multiple solid state light emitters and/or multiple lumiphoric materials (i.e., in combination with at least one solid state light emitter) may be used in a single device, such as to produce light perceived as white or near-white in character. In certain embodiments, the aggregated output of multiple solid state light emitters and/or lumiphoric materials may generate warm white light output having a color temperature range of from about 3000K to about 4000K.

Solid state emitters may be used individually or in combination with one or more lumiphoric materials (e.g., phosphors, scintillators, lumiphoric inks) and/or optical elements to generate light at a peak wavelength, or of at least one desired perceived color (including combinations of colors that may be perceived as white). Inclusion of lumiphoric (also called 'luminescent') materials in lighting devices as described herein may be accomplished by direct coating on solid state light emitter, adding such materials to encapsulants, adding such materials to lenses, by embedding or dispersing such materials within lumiphor support elements, and/or coating such materials on lumiphor support elements. Other materials, such as light scattering elements (e.g., particles) and/or index matching materials, may be associated with a lumiphor, a lumiphor binding medium, or a lumiphor support element that may be spatially segregated from a solid state emitter.

In some embodiments, an example fixture embodying the LED lighting system disclosed herein includes LED devices as the LED light source positioned on a mounting surface of a heatsink, wherein the mounting surface can be positioned either at or near the top of the back reflector, and the heatsink radiates heat up from the top of the fixture. In other embodiments, the heatsink and mounting surface are positioned at or near the lens arrangement of the fixture, and heat from the heatsink radiates down. The heatsink is at least partly in contact with the ambient air. In example embodiments, the fixture can be a troffer style fixture, which takes a form similar to commercial fixtures using fluorescent tubes. Such a fixture might be used as a solid-state replacement for a standard fluorescent light fixture, and/or might be of a form factor to be placed in the space normally occupied by drop ceiling tiles in an office environment. A fixture according to example embodiments can also designed to hang below a ceiling on stanchions, posts or chains and may or may not have a pan.

A fixture or LED lighting system can include a plurality of optical elements. The plurality of optical elements may include a reflector and a lens or a lens arrangement. A lens arrangement may consist of a single lens, a plurality of lenses, or either of these with additional components. In some embodiments, the lens arrangement includes a lens plate or portion that passes and diffuses some light from the LED light source. A lens plate may reflect some portion of the light back to the back reflector. In some embodiments, the lens arrangement includes at least a one lens plate that is highly reflective. In at least some embodiments, light passes out of the fixture through openings that are not covered by any lens plate.

A light fixture according to some embodiments of the invention includes a back reflector and a plurality of LED devices centrally disposed at either the back reflector or a lens arrangement. In some embodiments, the back reflector comprises two curved sections. In some embodiments, a heatsink is provided with a mounting surface for the plurality of LED devices. In some embodiments the lens arrangement comprises at least one lens plate with reflective filler. Example embodiments of the invention include a linear LED fixture utilizing different types of light directing properties in different parts of the light emitting portion of the fixture in order to achieve a balance of good color mixing, uniformity, and efficacy, with reduced contrast between different parts of the fixture to create a more uniform appearance when viewed from a room. By reduced contrast, what is meant is that the perceived intensity of the light coming from various areas of the opening of the light basket, such as areas that are open as opposed to covered with a plate or where the bottom of the heatsink is visible does not vary by large amounts.

The reduced contrast characteristic of a fixture according to example embodiments of the invention is achieved through any of various alternative arrangements of LEDs, a reflector or reflectors, open spaces, and/or a lens plate or lens plates, including diffusive lens plates and partially reflective lens plates. Additional mechanisms such as light pipes or slots to conduct light into portions of the fixture can also optionally be used. For example, in some embodiments the LED light source is positioned proximate to the reflector, and a partially reflective lens plate is positioned opposite the LED light source. This partially reflective lens plate allows some light to pass through, but also reflects some into the light basket. In some embodiments, the light source is disposed opposite of the reflector. The lens arrangement can include two lens plates adjacent to the LED light source and a heatsink to provide cooling. Light pipes conduct light into spaces around the lens plate and the heatsink so that this area does not appear darker than the rest of the fixture when viewed from a room. Slots or other mechanisms can also be used to conduct light into the spaces. These lens plates may be made partially reflective and may also diffuse light. Any of these mechanisms can be combined with open spaces if proper care is taken to design the fixture using these mechanisms to minimize contrast.

Figure 1B:
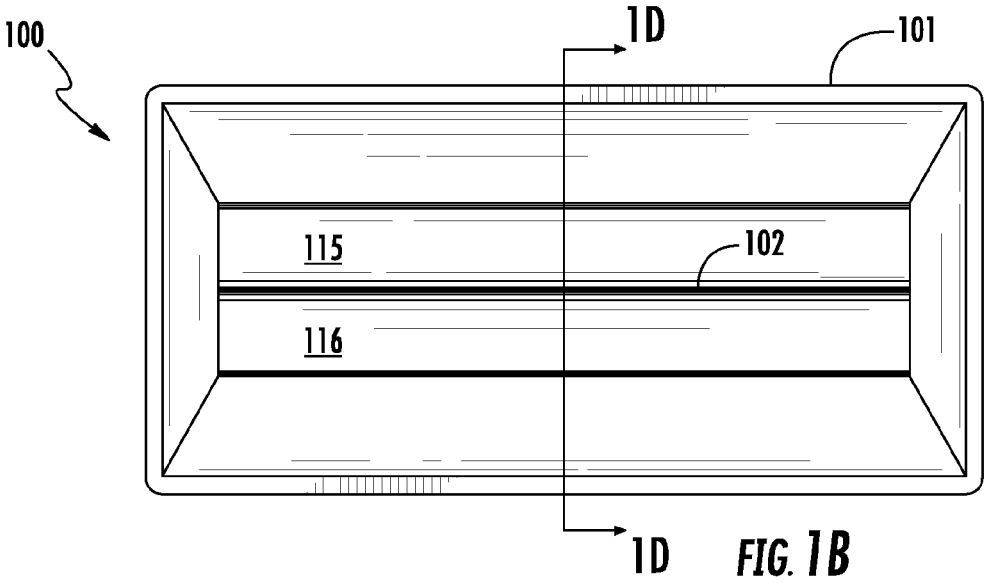
Figure 1C:
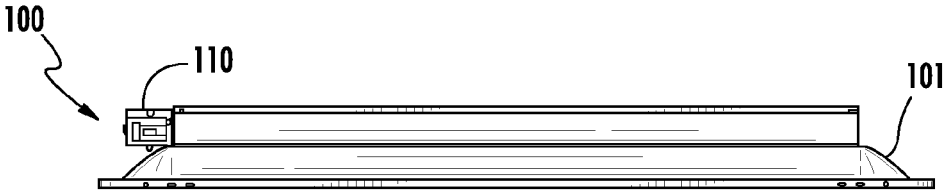
Figure 1D:
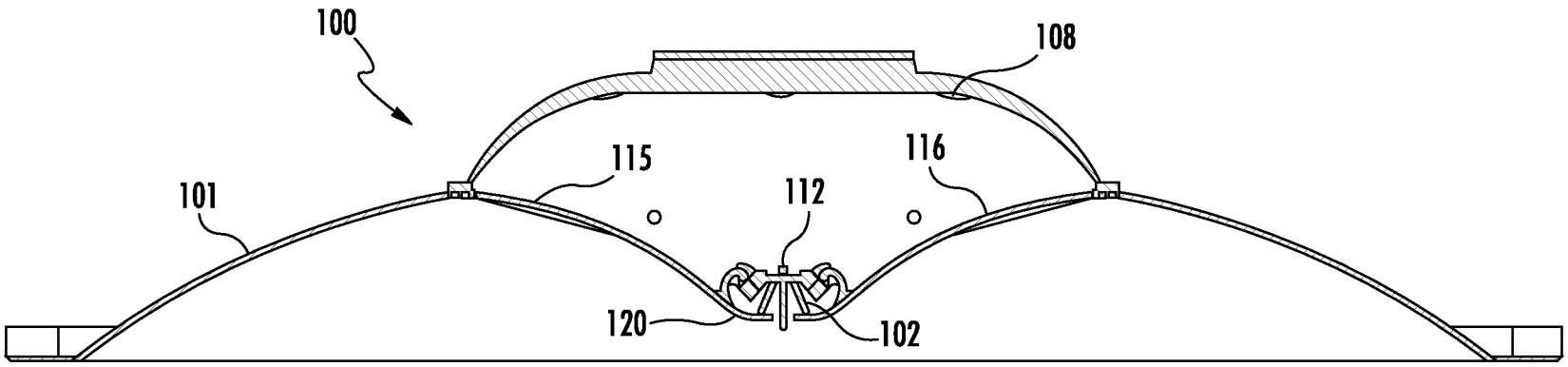

Various views of an example embodiment of the invention are shown in FIGS. 1A, 1B, 1C and 1D, which may be collectively referred to as FIG. 1. FIG. 1A is a perspective view of the fixture as seen from the light emitting side. FIG. 1B is a bottom view of the fixture. FIG. 1C is a side view of the fixture, and FIG. 1D is a cross-sectional view for a cross-section taken as indicated in FIG. 1B. Light fixture 100 is a linear fixture, which can be, as an example, a "troffer" style, in-ceiling linear light fixture. However, a similar reflector and light source according to embodiments of the invention can work with square or any of other various shapes and styles of fixtures. Light fixture 100 includes pan 101, heatsink 102, reflector 108 and circuit box 110 to house electronics used to drive and control the light source such as rectifiers, regulators, timing circuitry, and other components.

In the example of FIG. 1 reflector 108 includes a flat region opposite the mounting surface of the heatsink; however, a reflector for a troffer fixture according to embodiments of the invention can take various shapes. Light fixture 100 includes LED devices and/or packages 112 to serve as a light source. Light fixture 100 also includes a diffuser lens assembly made up of two lens plates, 115 and 116, disposed at the sides of the heatsink. As can be seen in FIG. 1D, the lens plates includes extensions, which clamp into a channel in heatsink 102, and curved portions 120 which extend around the fins of the heatsink. An arrangement of slots (openings) in the curved portions of the lens plates can be used to conduct light into the space between the curved portions of the lens plates and the heatsink. As an alternative, light pipes can conduct some of the light from the light basket of the fixture into the space between fins of the heatsink. These optional slots and light pipes are discussed in more detail with respect to FIGS. 5 and 6. With light emanating from the bottom of the heatsink, the light pattern for the fixture appears to be relatively or substantially even across the portion of the light fixture inside the pan, without a stark contrast between the lighted lens plates and a dark space taken up by the heatsink in the center of the fixture.

The LED devices fixture 100 can be mounted to face orthogonally to the mounting surface of the heatsink so as to face the center region of the reflector, or they may be angled to face other portions of the reflector. In some embodiments, baffles may be included at the sides of the heatsink to reduce the amount of light emitted from the LED light source at high angles that may escape the cavity of the light fixture without being reflected by reflector 108. Such baffles can help prevent hot spots or color spots visible when viewing the fixture at high viewing angles.

Figure 2A:
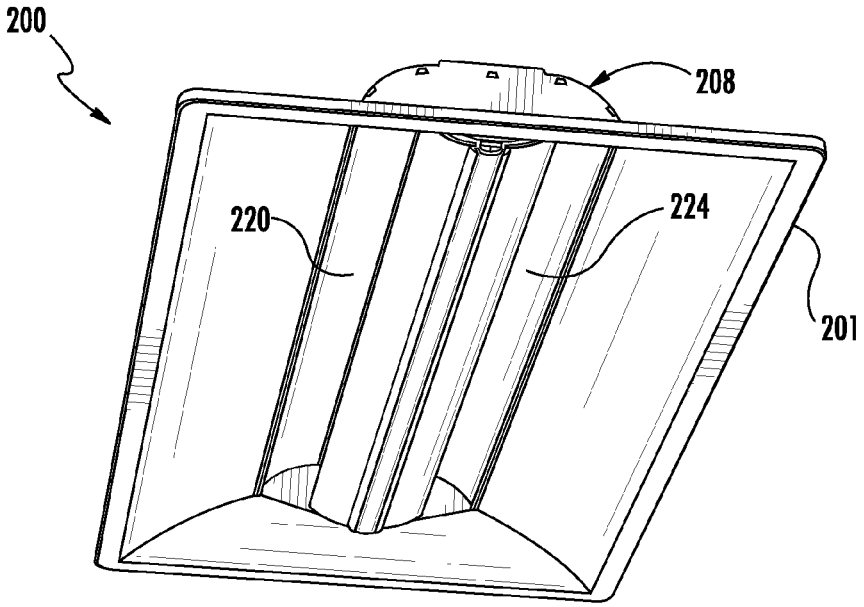
FIG. 2 presents various views of an example embodiment of the invention organized as FIGS. 2A, 2B, 2C, and 2D.
Figure 2B:
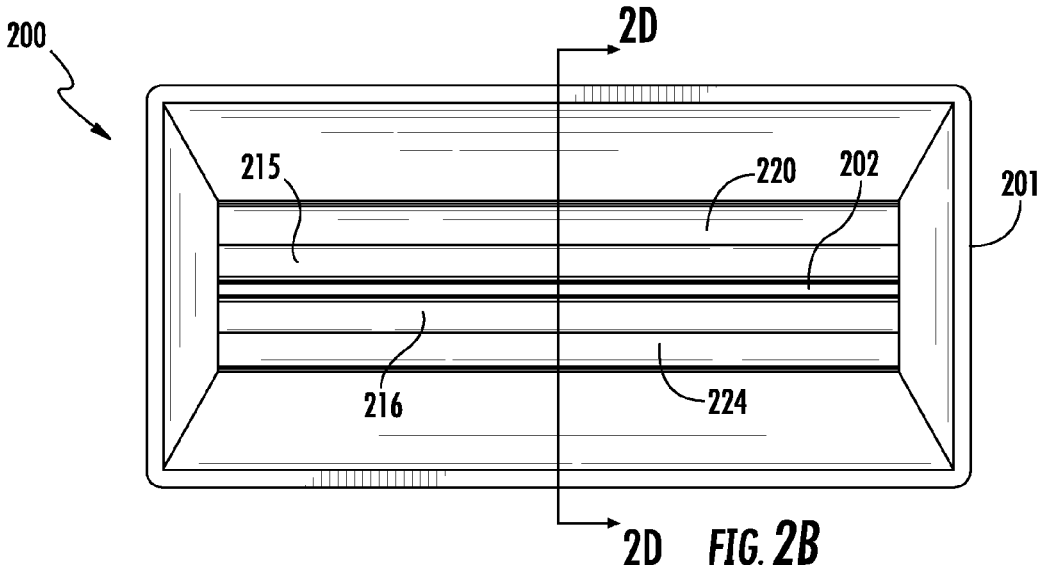
Figure 2C:
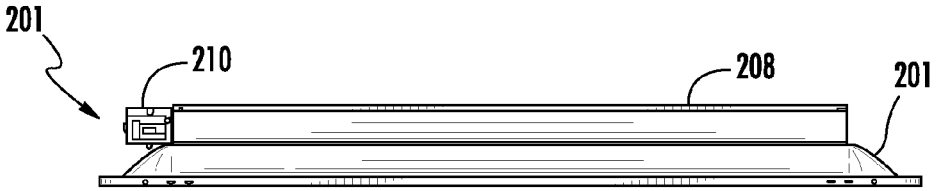
Figure 2D:
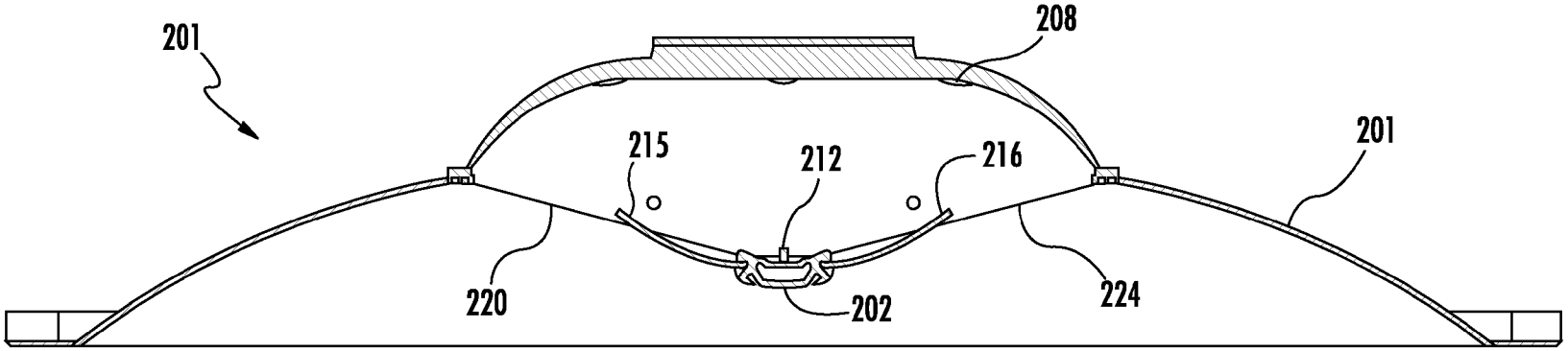

Various views of another example embodiment of the invention are shown in FIGS. 2A, 2B, 2C and 2D, which may be collectively referred to as FIG. 2. FIG. 2A is a perspective view of the fixture as seen from the light emitting side. FIG. 2B is a bottom view of the fixture. FIG. 2C is a side view of the fixture, and FIG. 2D is a cross-sectional view for a cross-section taken as indicated in FIG. 2B. Light fixture 200 is a linear fixture, which can be, as an example, a "troffer" style, in-ceiling linear light fixture. However, a similar reflector and light source according to embodiments of the invention can work with square or any of other various shapes and styles of fixtures. Light fixture 200 includes pan 201, heatsink 202, reflector 208 and circuit box 210 to house electronics used to drive and control the light source such as rectifiers, regulators, timing circuitry, and other components.

In the example of FIG. 2 reflector 208 includes a flat region opposite the mounting surface of the heatsink; however, a reflector for a troffer fixture according to embodiments of the invention can take various shapes. Light fixture 200 includes LED devices and/or packages 212 to serve as a light source. Light fixture 100 also includes a lens arrangement made up of two curved lens plates, 215 and 216, disposed at the sides of the heatsink. In example embodiments, these lens plates utilize an Acrylic base resin loaded with a reflective filler, such as $TiO_2$. This composition will give a translucent "white" appearance to this portion of the lens arrangement. Additionally these lens plates will appear darker than lens plates that are merely diffusive, and will reflect a significant portion of the light back to reflector 208. Open areas 220 and 224 are disposed at the sides of these lens plates.

In light fixture 200, much of the light from the light basket of fixture 200 emanates from these open areas without further diffusion, the light being adequately mixed by the multiple reflections in the light chamber. Depending on the loading of the reflective additive, the amount of light allowed through the lens plates vs. the amount of light reflected back into the chamber to can be varied. The higher the loading, the higher the reflectivity, but also the higher the optical loss. The loading of reflective additive into the center section is balanced with the distance from the LED strip at the top of the reflector chamber in order to provide maximum efficacy along with the best aesthetics. The closer the LEDs are to the back of the fixture, the more intensity will be apparent on the lens. Therefore it may be desirable to have less light bleed through; otherwise the increased intensity will be visible as higher surface luminance.

Still referring to FIG. 2, it should be noted that the area around heatsink 202 may be relatively dark. However, with lens plates 215 and 216 reflecting some light, and light passing through openings 220 and 224 unimpeded, the lens plates will appear darker than the lens plates in the embodiment of FIG. 1, and thus contrast between the heatsink and these lens plates is relatively or substantially reduced. The bottom of heatsink 202 is substantially flat and can be coated or painted white to further reduce the contrast between the heatsink area and the lens plates. The LED devices fixture 200 can be mounted to face orthogonally to the mounting surface of the heatsink so as to face the center region of the reflector, or they may be angled to face other portions of the reflector. In some embodiments, baffles may be included at the sides of the heatsink to reduce the amount of light emitted from the LED light source at high angles that may escape the cavity of the light fixture without being reflected by reflector 208. Such baffles can help prevent hot spots or color spots visible when viewing the fixture at high viewing angles.

Figure 3A:
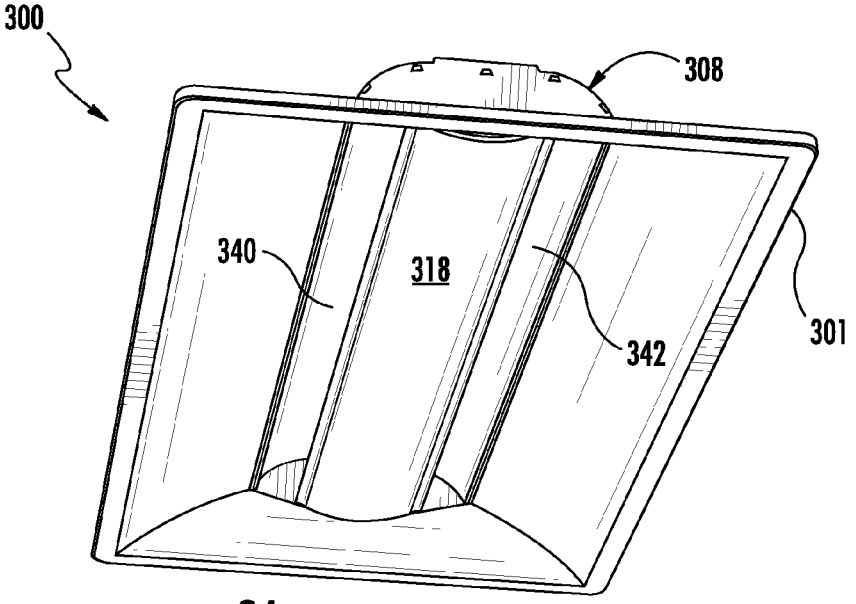
FIG. 3 presents various views of an example embodiment of the invention organized as FIGS. 3A, 3B, 3C, and 3D.
Figure 3B:
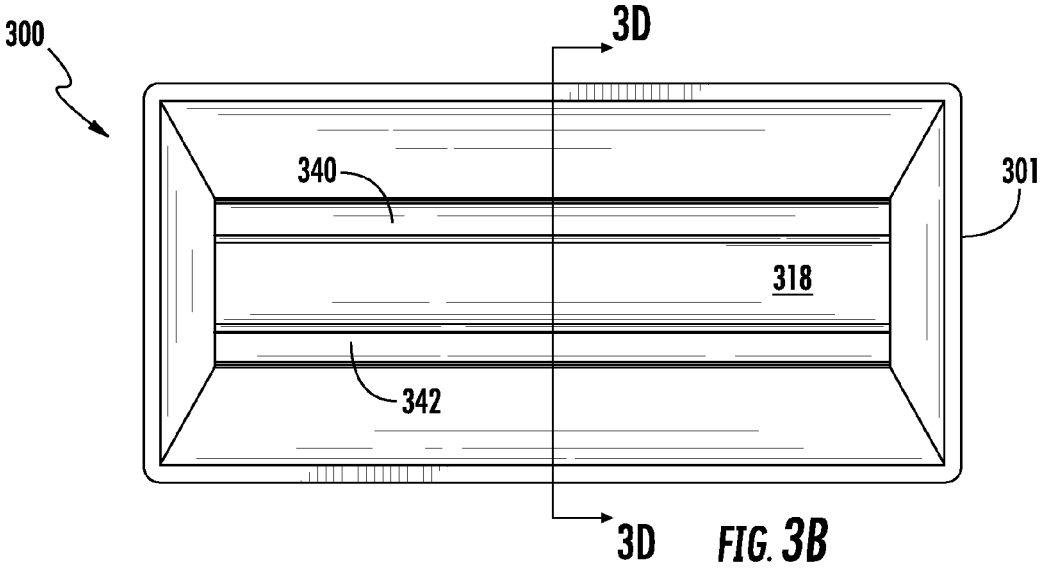
Figure 3C:
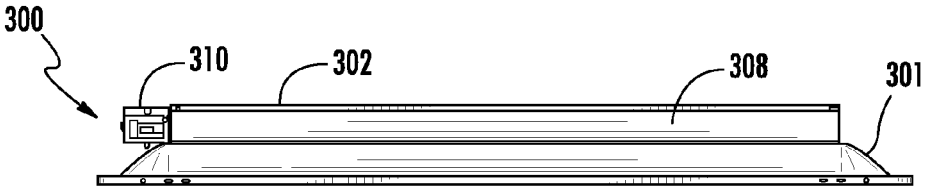
Figure 3D:
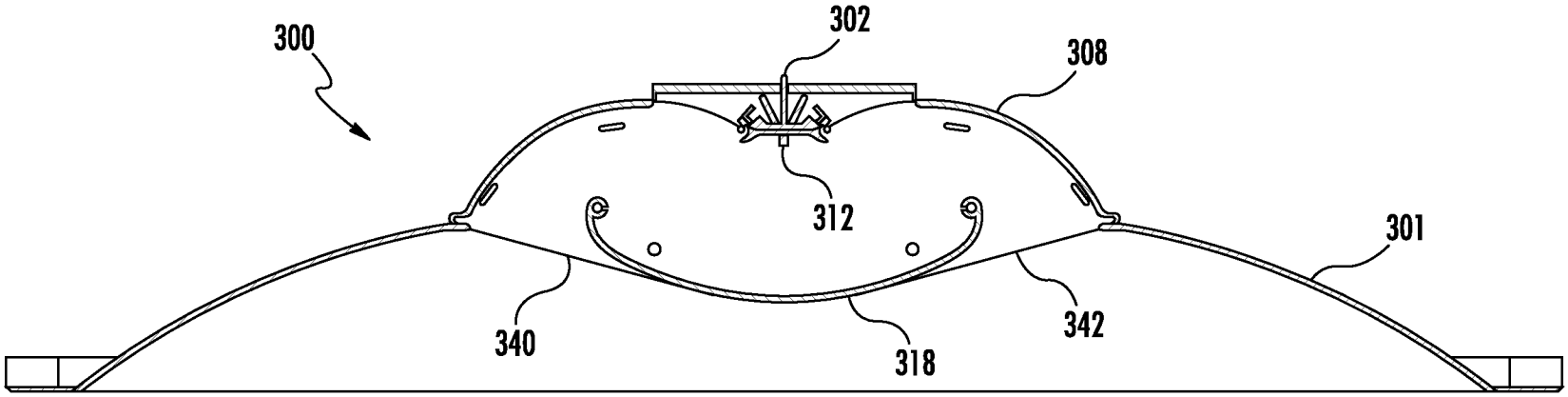

Various views of a further example embodiment of the invention are shown in FIGS. 3A, 3B, 3C and 3D, which may be collectively referred to as FIG. 3. FIG. 3A is a perspective view of the fixture as seen from the light emitting side. FIG. 3B is a bottom view of the fixture. FIG. 3C is a side view of the fixture, and FIG. 3D is a cross-sectional view for a cross-section taken as indicated in FIG. 3B. Light fixture 300 is a linear fixture, which can be, as an example, a "troffer" style, in-ceiling linear light fixture. However, a similar reflector and light source according to embodiments of the invention can work with square or any of other various shapes and styles of fixtures. Light fixture 300 includes pan 301, heatsink 302, reflector 308 and circuit box 310 to house electronics used to drive and control the light source such as rectifiers, regulators, timing circuitry, and other components. A center section of the fixture is directly illuminated by an LED light source 312 on the mounting surface of heatsink 302, which is in this embodiment coincident with the back reflector 308 of the fixture. Reflector 308 includes two curved sections, which may be parabolic in shape. Such a reflector may sometimes be referred to as a "gull" reflector or a reflector having a "gull" profile.

The lens arrangement for fixture 300 includes a single, curved lens plate 318, which in this example embodiment utilizes an Acrylic base resin and is loaded with reflective filler, such as $TiO_2$. This composition will give a translucent "white" appearance to this portion of the lens arrangement. Depending on the loading of the reflective additive, the amount of light allowed through the center section vs. the amount of light reflected back into the back chamber can be varied. The higher the loading, the higher the reflectivity and hiding power relative to the LEDs, but also the higher the optical loss. The loading of reflective additive into the center section is balanced with the distance from the LED strip at the top of the reflector chamber in order to provide maximum efficacy along with the best aesthetics. Cutting the distance between the LEDs and the diffuser/reflector lens in half will require between 2× and 4× the reflectivity of the center panel, depending on the characteristics desired. The balance will be non-uniformity in the center section (which will increase exponentially at the same loading) vs. optical efficiency (which will decrease linearly with increased $TiO_2$ loading). The closer the LEDs, the more intensity will be apparent on the lens. Therefore it may be desirable to have less light bleed through; otherwise the increased intensity will be visible as non-uniformity of the light.

Still referring to fixture 300 of FIG. 3, the outboard portions of the fixture consist of open spaces or slots 340 and 342. The lens plate receives light from the LED strip in a cone to either side of vertical. As most LEDs have a 100-120 degree FWHM (full width half max) the intensity of the light from the LEDs will have dropped dramatically by the time the LED light hits the, swept, upward pointing edges of lens plate 318, so that very little light escapes the fixture directly from the LED light source. Most light is reflected from the curved, central lens plate 318 onto back reflector 308, to eventually pass out of the fixture through openings 340 and 342. Any remaining high angle light will bounce off the curved, parabolic, back reflector sections in the back chamber. The reflective back or top of the chamber, in example embodiments, can be a diffuse white reflector. It can be appreciated that the distance between the LED board and the lens plate can be varied to affect the ratio of light that impinges on the reflective center section.

Figure 4A:
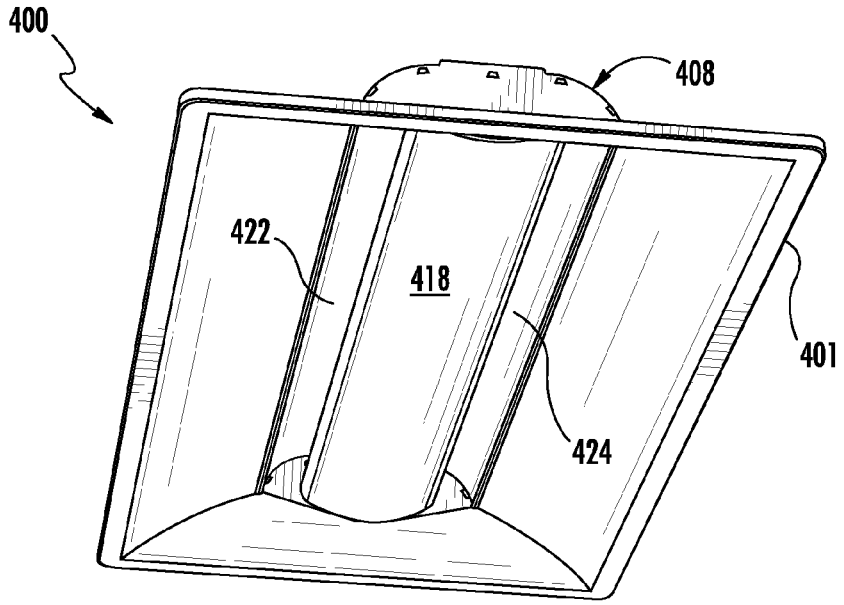
FIG. 4 presents various views of an example embodiment of the invention organized as FIGS. 4A, 4B, 4C, and 4D.
Figure 4B:
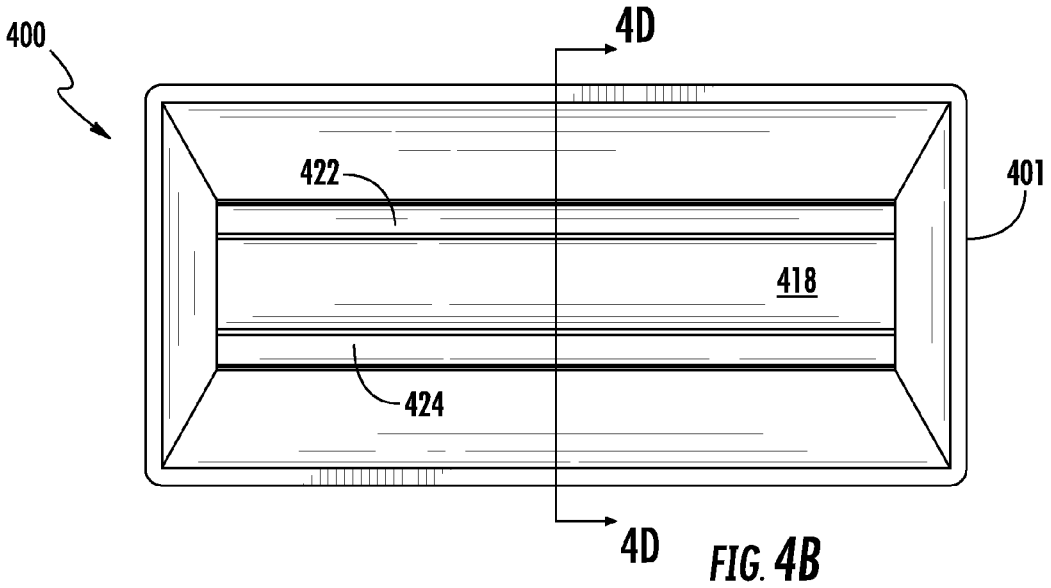
Figure 4C:
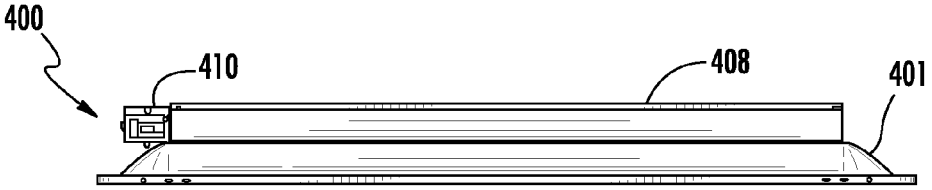
Figure 4D:
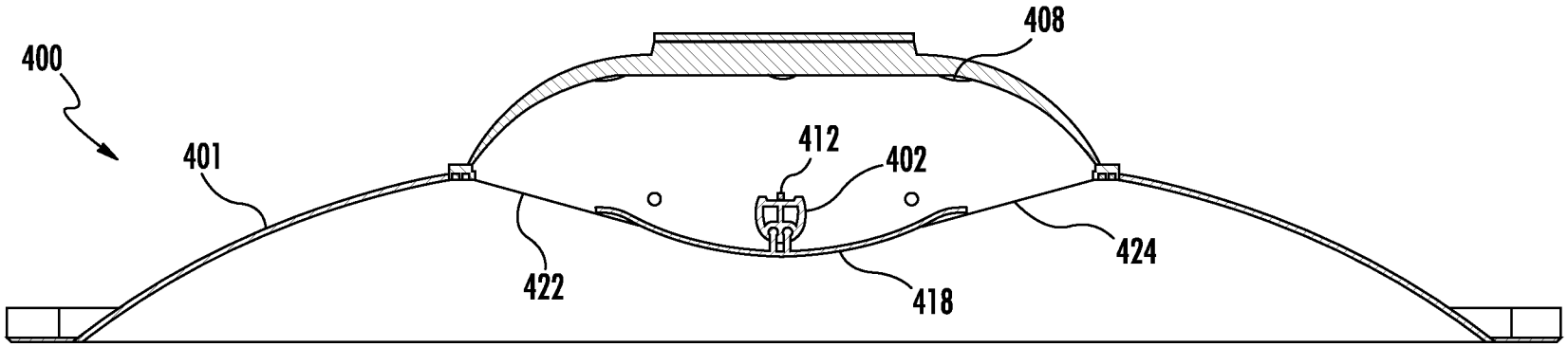

Various views of another example embodiment of the invention are shown in FIGS. 4A, 4B, 4C and 4D, which may be collectively referred to as FIG. 4. FIG. 4A is a perspective view of the fixture as seen from the light emitting side. FIG. 4B is a bottom view of the fixture. FIG. 4C is a side view of the fixture, and FIG. 4D is a cross-sectional view for a cross-section taken as indicated in FIG. 4B. Light fixture 400 is a linear fixture, which can be, as an example, a "troffer" style, in-ceiling linear light fixture. However, a similar reflector and light source according to embodiments of the invention can work with square or any of other various shapes and styles of fixtures. Light fixture 400 includes pan 401, heatsink 402, reflector 408 and circuit box 410 to house electronics used to drive and control the light source such as rectifiers, regulators, timing circuitry, and other components.

In the example of FIG. 4 reflector 408 includes a flat region opposite the mounting surface of the heatsink; however, a reflector for a troffer fixture according to embodiments of the invention can take various shapes. Light fixture 400 includes LED devices and/or packages 412 to serve as a light source. Light fixture 400 also includes a lens arrangement including at least a single lens plate, 418, disposed below heatsink 402. This lens plate again utilizes an Acrylic base resin loaded with reflective filler, such as $TiO_2$. This composition will give a translucent "white" appearance to the lens plate. Open areas 420 and 424 are disposed at the sides of the lens plate.

In light fixture 400, much of the light from the light basket of fixture 400 emanates from these open areas without further diffusion, the light being adequately mixed by the multiple reflections in the light chamber. Depending on the loading of the reflective additive, the amount of light allowed through the lens plate vs. the amount of light reflected back into the chamber to can be varied. The higher the loading, the higher the reflectivity, but also the higher the optical loss. The loading of reflective additive is balanced with the distance from the LED strip and the lens plate to the reflector in order to provide maximum efficacy along with the best aesthetics.

In FIG. 4D, the lens plate is shown with stanchions, which clamp into channels in the bottom of the heatsink 402. Thus, a space is maintained between the bottom of the heatsink and the curved lens plate, so that light can penetrate the area around the bottom of the heatsink. Further details of these stanchions are discussed with respect to FIG. 7. The reflective loading of lens plate 418 can be adjusted so that the lens plate only appears slightly darker then the light passing through openings 420 and 424 unimpeded, making for only a mild contrast difference between the openings and the lens plate, and there can be little or substantially no contrast difference between the outboard portions of the lens plate and the heatsink area.

As before, the LED devices fixture 400 can be mounted to face orthogonally to the mounting surface of the heatsink so as to face the center region of the reflector, or they may be angled to face other portions of the reflector. In some embodiments, baffles may be included at the sides of the heatsink to reduce the amount of light emitted from the LED light source at high angles that may escape the cavity of the light fixture without being reflected by reflector 408. Such baffles can help prevent hot spots or color spots visible when viewing the fixture at high viewing angles.

Various combinations of colors can be used for the color of light emitted by the LED devices mounted on the heatsink of the light fixture according to embodiments of the present invention. In some embodiments, substantially white light is produced. As one example, blue-shifted yellow (BSY) LED devices can be used as some of the light sources, and red-emitting LEDs can be used as additional light sources. The red LEDs may, when energized, emit light having dominant wavelength from 600 to 640 nm, or 605 to 630 nm, which in either case may be referred to as "red" light. The LED chips in the BSY LED device packages, when illuminated, emit light having a dominant wavelength from 435 to 490 nm, 440 to 480 nm, or 445 to 465 nm. These LEDs can be packaged with a local phosphor, where the phosphor emits light having a dominant wavelength from 540 to 585 nm, or 560 to 580 nm. These combinations of lighting elements can be referred to as a "blue-shifted yellow plus red" (BSY+R) system. This is but one example of a combination of lighting elements and phosphor that can be used to create substantially white light with a color rendering index (CRI) at least as good as generated by many older types of commercial and residential lighting. Phosphors can also be used remotely from the LEDs in the fixture, for example on or in lens plates or on the reflector. Embodiments of the invention can produce light with a CRI of at least 70, at least 80, at least 90, or at least 95. Further examples and details of mixing colors of light using solid state emitters and phosphor can be found in U.S. Pat. No. 7,213,940, which is incorporated herein by reference.

To further explain what is meant herein by "substantially white" light, the color of light can be indicated in a chromaticity diagram, such as the 1931 CIE Chromaticity Diagram. Such a diagram includes a blackbody locus of points, which indicates points in the color space for light that humans perceive as the same or close to natural sources of light. A good "white" light source is generally considered a source whose point in the color space falls within four MacAdam ellipses of any point in the blackbody locus of points. In some embodiments of the present invention, this distance can be achieved. However, if the point for the light from a luminaire according to embodiments of the invention falls within six MacAdam ellipses in some embodiments or ten MacAdam ellipses in some embodiments, such light would be considered substantially white light for purposes of this disclosure. Further discussion of CIE diagrams and the blackbody locus of points can be found in U.S. Pat. No. 7,768,192, which is incorporated herein by reference.

It should be noted that the heatsink shown in the figures provides an example only as many different heatsink structures could be used with an embodiment of the present invention. The mounting surface portion of the heatsink faces down into the interior cavity of the light fixture. The heatsink includes fin structures that radiate heat into the ceiling cavity or into the room when the fixture is mounted, depending on which heatsink placement is used. Because troffer style light fixtures are traditionally used in large areas populated with modular furniture, such as in an office for example, many fixtures can be seen from anywhere in the room. Specification grade fixtures often include mechanical shielding in order to effectively hide the light source from the observer once he or she is a certain distance from the fixture, providing a "quiet ceiling" and a more comfortable work environment. In some embodiments, the outer pan is sized and shaped to provide a primary cutoff of the light coming through lens plates to provide such mechanical shielding, while also providing mechanical support for back reflector and heatsink of the fixture.

Figure 5:
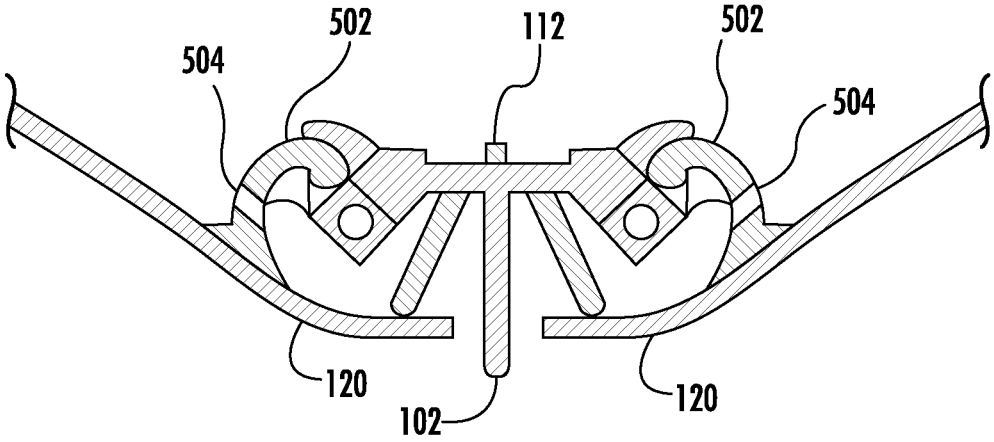
FIG. 5 shows a detailed cross-section of a portion of an embodiment of the invention illustrated in FIG. 1.

FIG. 5 illustrates a magnified, cross-sectional view of the detail where the lens plates in fixture 100 shown in FIG. 1 meet the heat sink, where slots are used to allow some light into spaces between heatsink fins. The lens plates of the fixture include extensions 502, which clamp into a channel in heatsink 102. Curved portions 120 extend around the fins of the heatsink as shown. Slots 504 conduct some of the light from the light basket of the fixture into the space between fins of the heatsink, which is mostly enclosed by curved portions 120 of the lens plates, so that some of the light from LED modules 112 ultimately emanates from the bottom of heatsink 102 through the curved portions 120 of the lens plates. With light emanating from the bottom of the heatsink, the light pattern for the fixture appears to be relatively or substantially even across the portion of the light fixture inside the pan, or possibly the entire light fixture if no pan is included, as may be the case with a hanging fixture. There is no stark contrast between the lighted lens plates and a dark space taken up by the heatsink in the center of the fixture.

Figure 6:
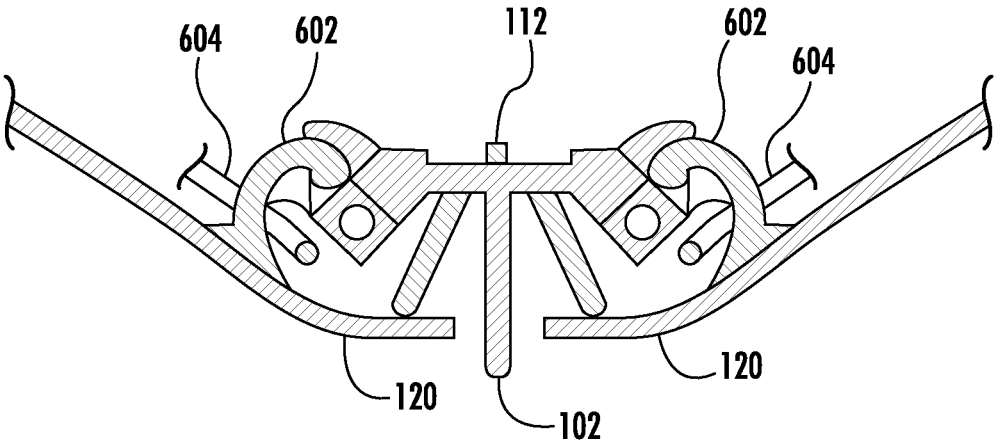
FIG. 6 shows a detailed cross-section of a portion of an alternate example of the embodiment of the invention illustrated in FIG. 1.

FIG. 6 illustrates a magnified, cross-sectional view of the detail where the lens plates in fixture 100 shown in FIG. 1 meet the heat sink, where light pipes are used to allow some light into spaces between heatsink fins. Extensions 602 clamp into a channel in heatsink 102. Curved portions 120 extend around the fins of the heatsink are shown. Light pipes 604 conduct some of the light from the light basket of the fixture into the space between fins of the heatsink. Again, with light emanating from the bottom of the heatsink, the light pattern for the fixture appears to be relatively or substantially even across the portion of the light fixture inside the pan, or possibly the entire light fixture if no pan is included, as may be the case with a hanging fixture.

Figure 7:
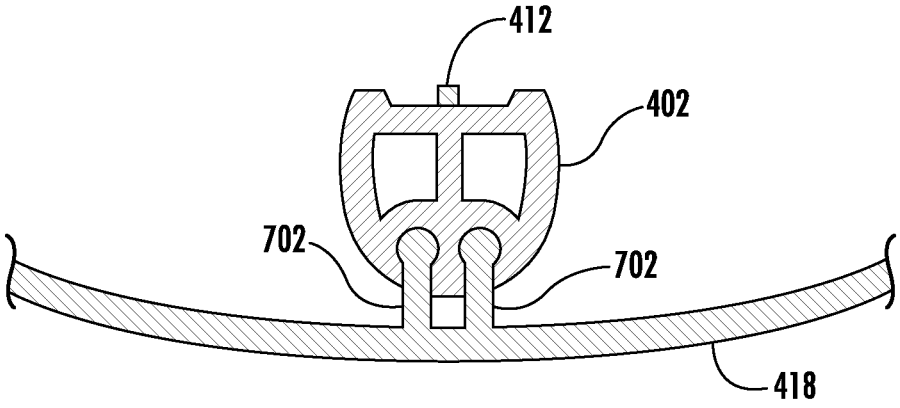
FIG. 7 shows a detailed cross-section of a portion of an embodiment of the invention illustrated in FIG. 4.

FIG. 7 is a magnified, cross-sectional view of the detail where the single lens plate in fixture 400 of FIG. 4 is connected to the heatsink. The lens plate includes stanchions 702, which clamp into channels in the bottom of the heatsink 402, which includes the mounting surface for LED modules 412. Thus, a space is maintained between the bottom of heatsink 402 and the curved lens plate, so that light penetrates to the stanchions 702 around the bottom of the heatsink. If the stanchions are made translucent additional light will penetrate to the space between the stanchions. Thus, some of the light from the fixture emanates from the bottom of heatsink 402. With light emanating from the bottom of the heatsink, the light pattern for the fixture can appear relatively or substantially balanced across the central portion of the light fixture. The reflective loading of lens plate 418 can be adjusted so that the lens plate only appears slightly darker than the other light emanating from the fixture, making for only a mild contrast difference.

Embodiments of the invention can use varied fastening methods and mechanisms for interconnecting the parts of the lighting system and luminaire. For example, in some embodiments locking tabs and holes can be used. In some embodiments, combinations of fasteners such as tabs, latches or other suitable fastening arrangements and combinations of fasteners can be used which would not require adhesives or screws. In other embodiments, adhesives, screws, bolts, or other fasteners may be used to fasten together the various components.

Although specific embodiments have been illustrated and described herein, those of ordinary skill in the art appreciate that any arrangement which is calculated to achieve the same purpose may be substituted for the specific embodiments shown and that the invention has other applications in other environments. This application is intended to cover any adaptations or variations of the present invention. The following claims are in no way intended to limit the scope of the invention to the specific embodiments described herein.

The invention claimed is:

1. A light fixture comprising:

a back reflector including a flat central region;

a heatsink including a mounting surface and fins;

a plurality of LED devices on the mounting surface of the heatsink, the LED devices facing the flat central region of the back reflector;

at least two lens plates adjacent to the heatsink; and a plurality of slots in a curved portion of the lens plates or light pipes through the curved portion of the lens plates, the slots or light pipes disposed to direct a portion of light from the LED devices into spaces between the curved portions of the lens plates and the fins of the heatsink so that a perceived intensity of the light from various areas including a space taken up by the heatsink does not vary by large amounts.

2. The light fixture of claim 1 wherein the plurality of LED devices further comprises at least two groups of LEDs, wherein one group, when illuminated, emits light having a dominant wavelength from 435 to 490 nm, and another group, when illuminated, emits light having a dominant wavelength from 600 to 640 nm, the one group being packaged with a phosphor, which, when excited, emits light having a dominant wavelength from 540 to 585 nm.

3. An LED lighting system comprising:

a heatsink including a mounting surface and fins;

a plurality of LEDs positioned on the mounting surface of the heatsink, the plurality of LEDs facing a flat central region of a reflector;

two lens plates adjacent to the LEDs and the heatsink to direct light into different parts of a light emitting portion of the LED lighting system; and a plurality of slots in a curved portion of the lens plates or light pipes disposed through a curved portion of the lens plates, to direct a portion of light from the LEDs into spaces between the curved portion of the lens plates and the fins of the heatsink so that a perceived intensity of light from various areas including a space taken up by the heatsink and/or the plurality of LEDs does not vary by large amounts.

4. A method of producing light from a fixture, the method comprising:

arranging a heatsink with a mounting surface and fins, a back reflector, and a plurality of LED devices on the mounting surface of a heatsink so that the LED devices face a central region of the back reflector and light from the plurality of LED devices strikes the back reflector before leaving the fixture;

energizing the plurality of LED devices;

passing light through two lens plates adjacent to the LED devices and the heatsink; and passing a portion of the light through a plurality of slots of light pipes in a curved portion of the two of lens plates, to direct the portion of the light into space between the fins of the heatsink and the curved portion of the lens plates so that a perceived intensity of the light from various areas across a space of the fixture taken up by the heatsink does not vary by large amounts.

* * * * *